US005133905A

United States Patent [19]

Woody et al.

[11] Patent Number: 5,133,905

[45] Date of Patent: Jul. 28, 1992

[54] FUEL METERING METHOD AND APPARATUS

[75] Inventors: John C. Woody, Caro; Mark S. Swanson, Cass City, both of Mich.

[73] Assignee: Walbro Corporation, Cass City, Mich.

[21] Appl. No.: 594,021

[22] Filed: Oct. 9, 1990

Related U.S. Application Data

[63] Continuation-in-part of Ser. No. 426,672, Oct. 26, 1989, abandoned.

[51] Int. Cl.[5] ..... F02M 5/08; F02M 17/04

[52] U.S. Cl. ..... 261/35; 261/69.2; 261/70; 261/DIG. 67; 261/DIG. 68

[58] Field of Search ..... 261/35, DIG. 68, DIG. 67, 261/70, 69.2

[56] References Cited

U.S. PATENT DOCUMENTS

| | | | |
|---|---|---|---|
| 1,720,916 | 7/1929 | Monier | 261/69.2 |
| 2,232,351 | 2/1941 | Udale | 261/69.2 |
| 2,507,075 | 5/1950 | Wiegand et al. | 261/69.2 |
| 2,552,056 | 5/1951 | Orr, Jr. | 261/69.2 |
| 2,796,243 | 6/1957 | McDuffie | 261/DIG. 67 |
| 2,937,858 | 5/1960 | Blodgett | 261/69.2 |
| 3,236,505 | 2/1966 | Phillips | 261/DIG. 68 |
| 4,159,012 | 6/1979 | Pizzuto et al. | 261/DIG. 68 |
| 4,323,522 | 4/1982 | Rasmussen | 261/DIG. 67 |
| 4,499,032 | 2/1985 | Shibano | 261/DIG. 67 |
| 4,759,883 | 7/1988 | Woody et al. | 261/DIG. 68 |

FOREIGN PATENT DOCUMENTS

| | | | |
|---|---|---|---|
| 1281748 | 10/1968 | Fed. Rep. of Germany | 261/DIG. 67 |
| 2316787 | 10/1974 | Fed. Rep. of Germany | 261/DIG. 67 |
| 504777 | 4/1920 | France | 261/DIG. 67 |
| 2386690 | 11/1978 | France | 261/DIG. 67 |

*Primary Examiner*—Tim Miles

*Attorney, Agent, or Firm*—Barnes, Kisselle, Raisch, Choate, Whittemore & Hulbert

[57] ABSTRACT

Method, system and apparatus for metering fuel to an internal combustion engine via a carburetor having a mixture conduit with a venturi therein. A main fuel nozzle supplies fuel to the venturi of the carburetor in response to the static pressure drop induced across an associated main fuel flow controlling restriction by the engine intake induced air flow through the carburetor mixture conduit. A pitot tube is disposed in the venturi with an opening facing upstream in a zone of maximum air flow through the carburetor venturi. A vent passageway system connects the pitot tube to a single closed air chamber cooperable with either a diaphragm or a float to regulate operation of an inlet valve controlling flow of fuel to a main fuel controlling restriction. The adverse effect of engine intake induced tuning pressure wave forms in the mixture conduit of the carburetor transitting the venturi is eliminated, reduced or modulated by the dynamic pressure exerted by said tuning waves at the pitot tube and transmitted by the vent passageway to said chamber and to said main fuel restriction.

12 Claims, 7 Drawing Sheets

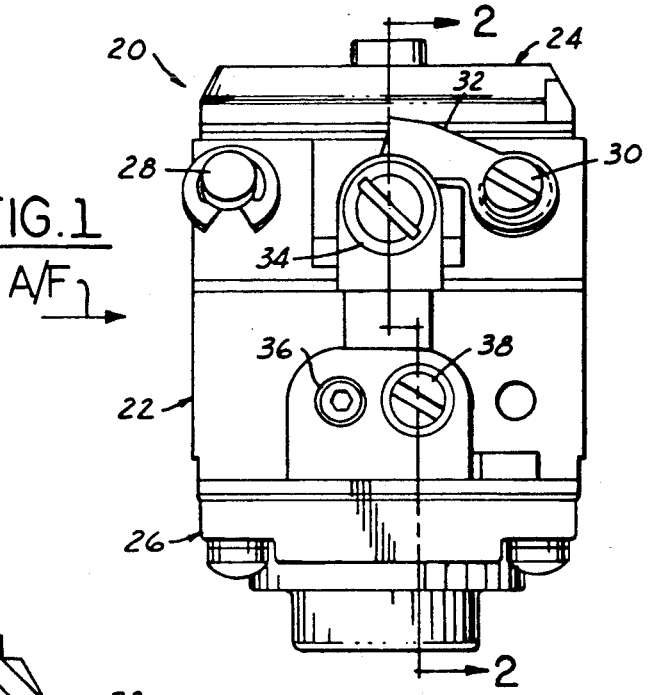
FIG.1
FIG.2
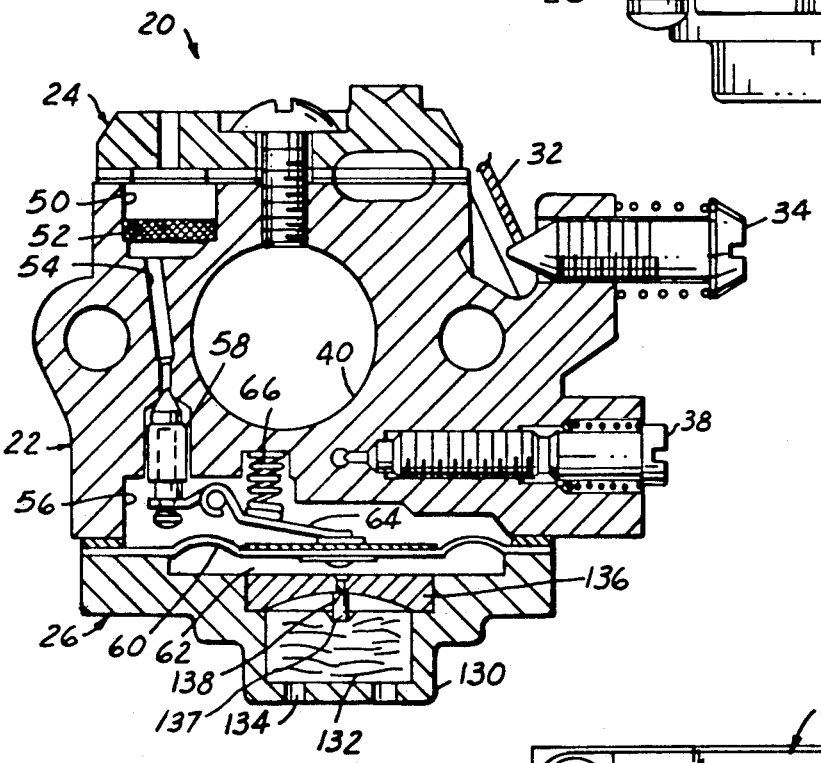
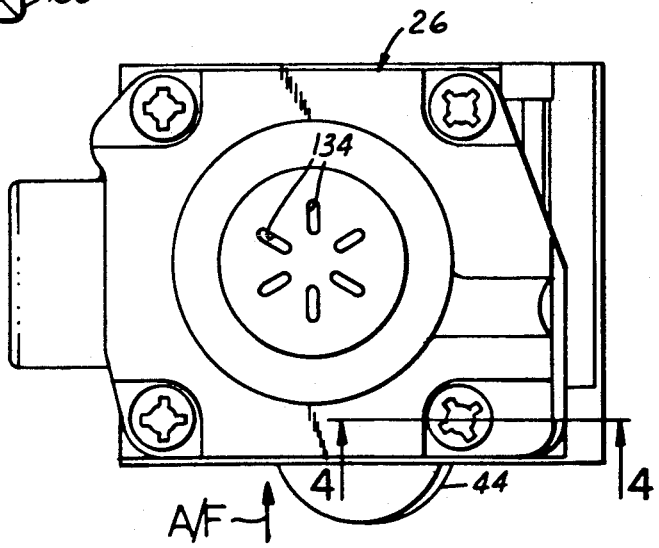
FIG.3

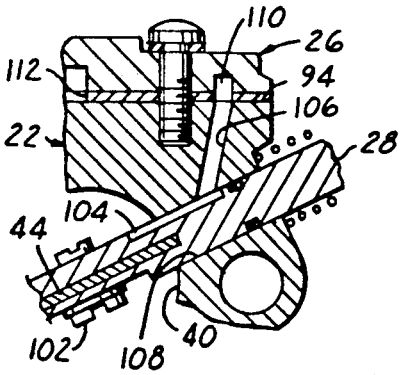
FIG.4
FIG.5
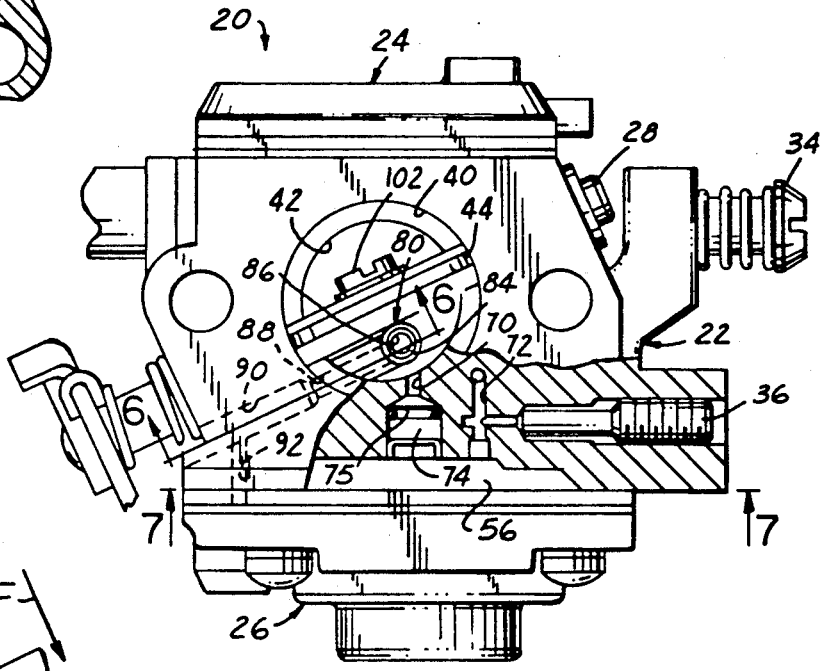
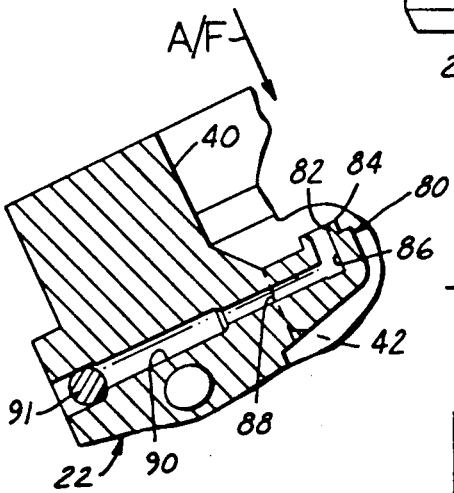
FIG.6
FIG.7
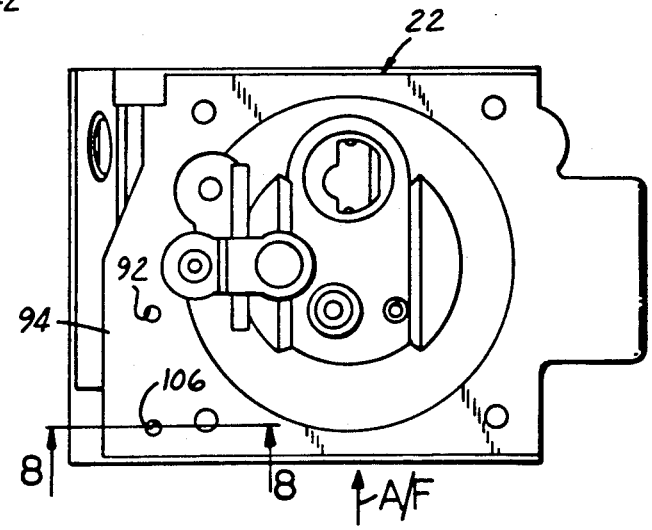

FULLY CLOSED CHOKE

15° BEFORE CLOSING

FULLY OPEN CHOKE

FIG.23
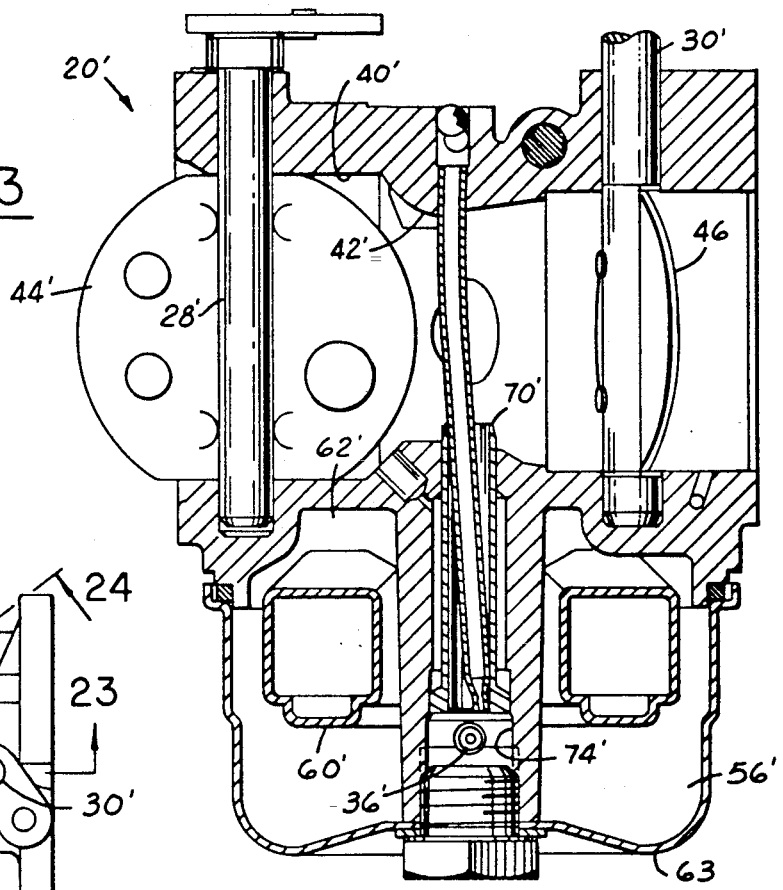
FIG.22
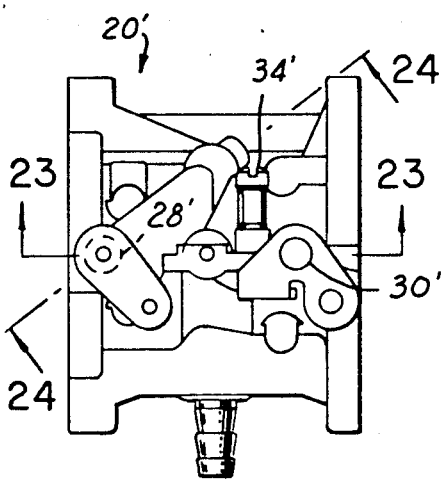
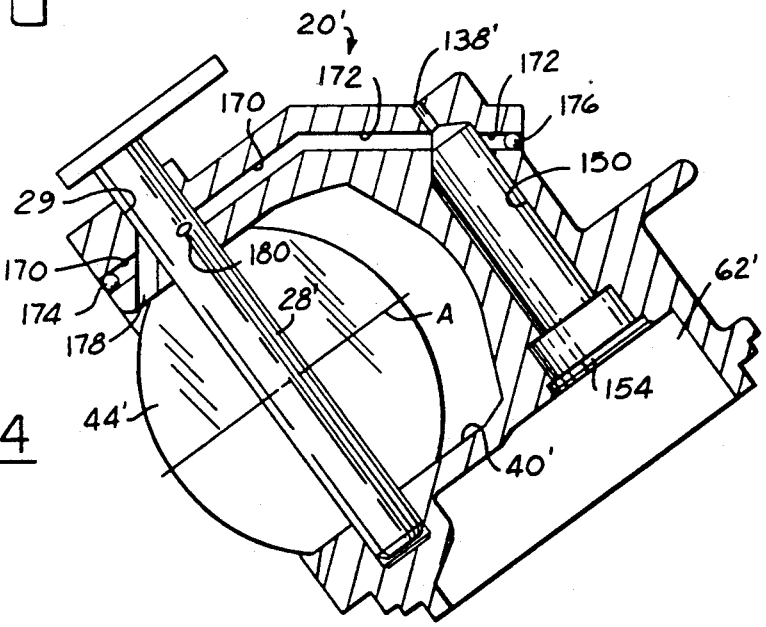
FIG.24

FUEL METERING METHOD AND APPARATUS

This application is a continuation-in-part of our copending U.S. Pat. Application Ser. No. 07/426,672, filed Oct. 26, 1989 now abandoned

FIELD OF THE INVENTION

The present invention relates to fuel metering for engines using carburetors, and more particularly to a small diaphragm-type or float-bowl-type carburetor for small internal combustion engines such as used in portable tools such as chain saws, in lawn mowers and other power lawn and garden equipment and in small off-road sport vehicles, etc.

BACKGROUND OF THE INVENTION

The fuel flow in diaphragm-type carburetors is dependent upon the pressure differential existing between the carburetor venturi and atmosphere. The venturi pressure depends upon engine design characteristics and operating conditions. A diaphragm-type carburetor generally comprises a mixture conduit in which fuel is mixed with air for delivery to the intake manifold of an engine, a fuel chamber closed by a diaphragm and communicating through a nozzle with the mixture conduit for delivery of fuel thereto, and valve means controlled by the diaphragm for controlling delivery of fuel from a fuel tank to the fuel chamber. An air filter is provided for cleaning air entering the mixture conduit. The mixture conduit is formed with a restriction, e.g., a venturi. With the engine in operation, air flows through the mixture conduit, a pressure drop occurs across the venturi (i.e. a partial vacuum is created in the venturi), and pressure on the outside of the diaphragm causes the diaphragm to flex inwardly and effect delivery of fuel through the nozzle, which is usually located at the throat of the venturi where the pressure drop is at maximum, and this diaphragm flexure effects opening of the valve means for delivery of fuel to the fuel chamber.

It is well known that intake tuning of engines often has an adverse affect on the fuel metering characteristics of the carburetor, particularly with respect to single cylinder engines operable over a relatively wide speed range. Engine intake tuning can cause the carburetor to deliver fuel in an incorrect ratio to the air flow due to unsteady air flow through the carburetor and to the effect of the moving pressure wave forms in the manifold and carburetor bore. These wave forms are created by the opening and closing of the engine intake valve(s) or port(s), and travel at the speed of sound, their behavior being well known in the art.

The effect of the moving pressure wave forms on the fuel delivered from the nozzle of the carburetor has long been a source of problems for the carburetor design engineer. The wave effect is superimposed on the normal vacuum caused by the engine intake air stream flow through the venturi. This in turn causes the nozzle to deliver fuel in a manner which is not fully responsive to the vacuum caused by the air flow. The carburetor will function properly when the pressure drop P across the main jet (some distance from the nozzle outlet in the venturi) is proportional to the density and the square of the velocity of the air flow, i.e., $$\Delta P = \frac{\rho V^2}{2}.$$

The tuning waves are superimposed on the venturi pressure drop and adversely effect fuel metering otherwise designed to follow this relationship. More particularly, this tuning wave is imposed on the fuel delivery side of the main jet and adversely affects the desired design value of the pressure drop $\Delta$ P, across the main nozzle-fuel controlling restriction.

It is believed that such tuning waves, i.e., air pressure waves generated in the carburetor mixture conduit by the sudden opening and closing of the engine intake port, are responsible for such well known problems as fuel "spit back" under certain engine operating conditions as well as certain abnormal and less well recognized deviations in the desired engine-carburetor performance curves plotting fuel-air ratio against engine speed, (e.g., undesirable "rich or lean spots" in the performance curves) and related plots of such parameters as specific fuel consumption, engine power output, exhaust constituents, etc.

Another well known problem adversely affecting the desired or design fuel metering characteristics of a carburetor, whether of the diaphragm or float type, is the gradual clogging by dirt, dust and/or other solid air borne particles of the engine air intake filter customarily disposed in front of the air entrance to the carburetor mixture conduit.

OBJECTS OF THE INVENTION

Accordingly, it is a principal object of this invention to provide a fuel metering system, apparatus and method, particularly for a carburetor of the class described, which functions effectively to better maintain a predetermined air and fuel ratio by canceling or modulating the adverse effect of the aforementioned moving pressure tuning wave forms operable upon the pressure drop across the main jet or other controlling fuel restriction feeding into the carburetor venturi.

Another object is to provide an improved carburetor incorporating the aforementioned system which is also operable as a vent system for the "dry" side of the diaphragm chamber which functions effectively to prevent or reduce adverse effects of air filter clogging relative to the maintenance of a predetermined air and fuel ratio.

A still further object is to provide a fuel metering system method and apparatus of the aforementioned character which may also be applied to float feed carburetors in a manner similar to the application thereof to diaphragm carburetors.

Yet another object of the present invention is to provide a fuel metering system and method of the aforementioned character in which the effect of the aforementioned tuning waves is utilized to advantage to modulate the fuel metering system in a favorable manner to produce varying effects such as a lean mixture for an economy range and/or a rich mixture for a power range.

SUMMARY OF THE INVENTION

Briefly, the objects of the invention are accomplished by providing a diaphragm carburetor with a vent passageway system operable to sense dynamic as well as static components of the engine tuning pressure wave imposed on the air stream in the carburetor venturi and to route the same to the underside ("dry side") of the diaphragm in such a manner that the pressure wave will be better imposed on both sides of the diaphragm, thus essentially canceling the adverse effect of the pressure wave and leaving only the desired ΔP pressure drop operable between the diaphragm fuel chamber and venturi main nozzle. This is accomplished by communicating one end of the vent passageway with the dry side of the diaphragm chamber and the other end of the vent passageway, via a special air pressure sensing pitot tube, with the carburetor venturi, the pitot tube being oriented and located in a predetermined manner therein relative to the intake air flow stream and main fuel nozzle outlet so that the pitot tube and the fuel nozzle are exposed to the same tuning pressure wave at the same instant of time. Alternatively, the vent passageway pitot tube and the main fuel nozzle opening are offset slightly from one another in the venturi passage by a predetermined leading or lagging amount in the direction of wave propagation in the carburetor throttle bore to thereby introduce a leading or lagging wave impingement relationship between these two venturi openings. This creates a predetermined phase shift in the affect of the pressure wave upon the metering pressure drop so as to modify it in a favorable manner to thereby produce a leaner mixture for an economy range of the engine or a richer mixture for a power range of the engine, depending upon the direction and amount of the predetermined offset spacing between the pitot tube and main jet fuel nozzle.

Similarly, in a float-bowl-type carburetor, the aforementioned one end of the vent passageway communicates with the head space of the fuel sump or well in the float bowl, the surface of the fuel and the float therein being considered the equivalent of the diaphragm, and the bowl headspace being treated as the "dry side" chamber.

BRIEF DESCRIPTION OF THE DRAWINGS

Other objects as well as features and advantages of the present invention will be more fully understood from the following detailed description of exemplary but preferred embodiments shown by way of example in the accompanying drawings, which are to scale unless otherwise stated, wherein:

FIG. 1 is a side elevational view of a small, compact diaphragm carburetor designed for a chain saw engine application incorporating the improved fuel metering system in a first embodiment of the present invention, the intended direction of engine intake air flow through the carburetor being indicated by the arrow A/F.

FIG. 2 is a cross sectional view taken on the line 2—2 of FIG. 1.

FIG. 3 is a bottom view of the carburetor of FIG. 1 and rotated 90° from the orientation in FIG. 1.

FIG. 4 is a fragmentary cross-sectional view taken on the line 4—4 of FIG. 3, and is an inverted view relative to FIGS. 1, 2 and 5.

FIG. 5 is a elevational view of the carburetor of FIG. 1 looking into the choke end of the mixing passage and having a portion broken away and shown in cross section to better illustrate detail.

FIG. 6 is a fragmentary cross-sectional view taken on the lines 6—6 of FIG. 5.

FIG. 7 is a view taken on the line 7—7 of FIG. 5 illustrating the bottom of the carburetor body with the bottom plate removed.

FIG. 22 is a top plan view of the carburetor of FIG. 12 rotated 90° about the carburetor axis from the illustration of FIG. 17.

FIG. 23 is a cross-sectional view taken on the line 23—23 of FIG. 22 but enlarged double sized thereover.

FIG. 24 is a cross-sectional view taken on the line 24—24 of FIG. 22 but enlarged double size thereover.

DETAILED DESCRIPTION

Figure 8:
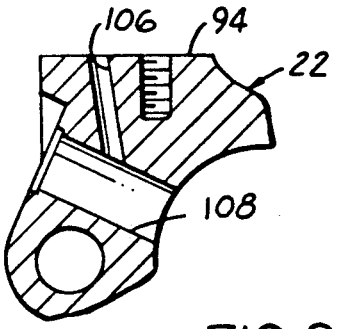
FIG. 8 is a fragmentary cross-sectional view taken on the line 8—8 of FIG. 7.

Referring in more detail to the accompanying drawings, FIG. 1 illustrates by way of example a diaphragm carburetor 20 designed for use with a chain saw engine and incorporating the best mode presently known for carrying out the fuel metering system of the invention. Except where indicated hereinafter, carburetor 20 is of known design embodying conventional but state of the art constructional features. Carburetor 20 has a main body 22 with a top cover or cap plate 24 secured to its upper surface and a bottom cover assembly 26 secured to its under surface. From the side view of FIG. 1, the upper ends of the choke shaft 28 and throttle shaft 30 may be seen, as may the throttle stop arm 32, throttle stop adjustment screw 34, high speed needle valve 36 and low speed needle valve 38.

As best seen in FIGS. 2 and 5, carburetor 20 has a mixture conduit or bore 40 and a venturi constriction 42 disposed within bore 40. A choke valve 44 is mounted on choke shaft 28 and disposed in the entrance (in the choke bore) to bore 40 upstream of venturi 42, while a throttle valve (not shown) is provided on throttle shaft 30 so as to be disposed in bore 40 (in the throttle bore) downstream of venturi 42.

Fuel may be supplied to the carburetor by a pump (not shown) which may be formed by components disposed in and between cover 24 and body 22, as will be understood by those skilled in the art. The fuel pump discharge is connected through a passage 50 and filter screen 52 with a passage 54 leading to the metering chamber 56 of the carburetor. A needle valve 58 in passage 54 is controlled by a diaphragm 60 disposed between the metering or "wet" chamber 56 and a vent or "dry" chamber 62. Diaphragm 60 is connected with valve 58 by a lever 64 which is biased by a spring 66 in a direction to move valve 58 toward closed position.

The main fuel nozzle outlet 70 opens into venturi 42 of the carburetor and, in accordance with conventional practice, has its axis oriented perpendicular to the axis of venturi 42 and direction of engine intake air flow in bore 40. Hence primarily or only static pressure of the air flow is sensed by nozzle 70. Nozzle 70 is connected via the main fuel metering system, to metering chamber 56 through a fuel passageway network, including the adjustable high speed needle valve 36 which controls flow through a passageway 72 leading, via such network, to the fuel well 74 feeding, via capillary seal screen 75, nozzle outlet 70. Preferably high speed needle valve 36 is a temperature compensating needle valve which serves as the main fuel metering restriction, and is constructed in accordance with the disclosure and claims of the Woody and Swanson U.S. Pat. No. 4,759,883, issued Jul. 26, 1988 and assigned to the assignee of record herein, the same being incorporated herein by reference.

In accordance with a principal feature of the present invention, carburetor 20 is provided with a vent passageway system operable to modify and/or cancel the effects of tuning pressure waves transiting venturi 42 which otherwise would adversely affect the metering function of needle valve 36 and associated passageway 72.

Figure 9:
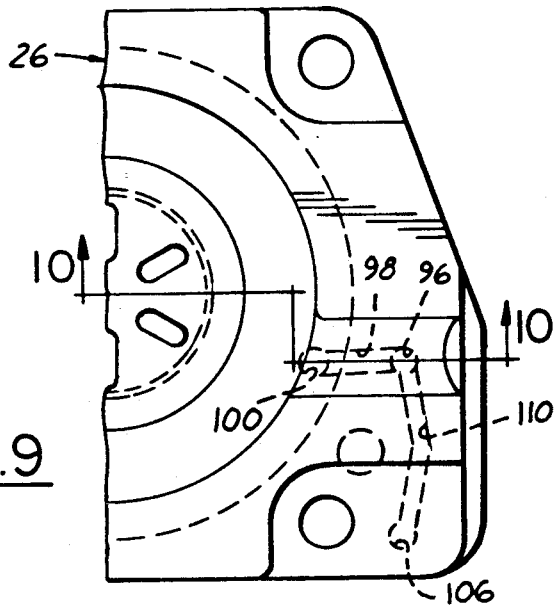
FIG. 9 is a fragmentary bottom plan view of the bottom cover assembly of the carburetor shown by itself.
Figure 11:
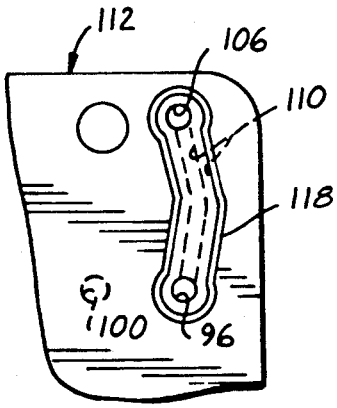
FIG. 11 is a fragmentary top plan view of a portion of a sealing gasket of the bottom cover assembly taken on the line 11—11 of FIG. 10.

This vent passageway interconnects a specially constructed pressure sensing port in venturi 42 with the dry side chamber 62. Referring to FIGS. 5 and 6, a pitot tube protruberance 80 is cast integrally with the body 22 so as to project from venturi 42 into the air flow stream drawn through bore 40 by engine intake suction. Projection 80 has a flared mouth 82 defined by a integral hood 84 leading to a short entrance passage 86. The axis of passage 86 is parallel to the axis of bore 40, and thus, mouth 82 faces directly upstream relative to the air flow through bore 40. Mouth 82 defines the end of the vent passageway system communicating with the carburetor throat. Passage 86 constitutes a blind bore which is connected near its blind end to a passage 88, the axis of which is disposed perpendicular to the axis of bore 86. Passage 88 merges with a coaxial counterbore 90 closed at its outer end by a press fit ball 91. Passage 90 is intersected by a short passage 92 (shown schematically in phantom by dash lines in FIG. 5) which in turn opens to the bottom face 94 of body 22, as best seen in FIG. 7. Passage 92 communicates with a passage 96 formed in bottom cover 26 (FIGS. 9, 10 and 11), and passage 96 is connected by a passage 98 and 100 to the dry side chamber 62. Passage 100 constitutes the opposite end of the vent passageway system communicating with the dry side of the diaphragm metering chamber 62.

In accordance with the present invention, it has been found that the entrance 82 of the vent passageway communicating with bore 40 should be located in the plane of the circle defined by venturi 42, which plane also includes the outlet of nozzle 70. It has also been found that this entrance to the vent passageway is preferably configured as a pitot tube, as shown in FIGS. 5 and 6, having the flared mouth 82 and hood 84. Moreover, the axis of the entrance passage 86 should preferably be located within a zone in the aforementioned venturi plane where the air stream velocity in bore 40 and passing through venturi 42 is at a maximum under engine operating conditions when choke valve 44 is fully opened.

Thus, as best seen in FIG. 5 when carburetor 20 is provided with choke shaft 28 and associated choke valve plate 44, opening 86 is located generally in the center of the chordal segment defined by the lower edge of shaft 28 and the portion of venturi 42 disposed between shaft 28 and nozzle 70. The diametrically opposed chordal segment in this plane, located on the other side of shaft 28, could likewise be chosen for locating pitot tube projection 80, but the head of the mounting stud 102 for choke plate 44 offers a slight obstruction to this side of the choke shaft 28 and hence the aforementioned chordal zone closer to nozzle 70 is chosen as preferred in this particular arrangement. If carburetor 20 were not provided with a choke shaft 28 and associated choke valve 44, the axis of entrance 86 of the pitot tube 80 preferably would be disposed coincident with the axis of venturi 42 (and bore 40), inasmuch as air stream velocity would be greatest at the center of an unobstructed venturi. Preferably, in the working embodiment illustrated herein, the total axial length of interconnected passages 86, 88, 90, 92, 96, 98 and 100 is 0.336 inches and the diameter of these passages ranges from about 0.049 to about 0.062 inches respectively, the diameter of venturi 42 is 0.546 inches, the diameter of shaft 28 is 0.186 inches, and the axis of passage 86 is located 0.095 inches from the nearest point on the surface of venturi 42.

Inasmuch as carburetor 20 is provided with a choke valve 44, and pitot tube 80 is located directly downstream of valve 44, in accordance with another feature of the invention a shunt passageway system is provided for producing a bypassing "shut-off" of the effect of the vent passageway 82-100 when initiating choke valve closure, i.e., after the first 5° of rotation of choke shaft 28 from its fully opened position on FIG. 5 toward its closed position. This "shutoff" shunt passageway comprises a slot or flat 104 formed in shaft 28 (FIG. 4) which is continuously open at one end to carburetor bore 40 and extends axially of shaft 28 so as to extend into body 22 from bore 40 a sufficient distance to selectively register with a passageway 106 formed in body 22 in response to rotation of shaft 28. The intersection of passage 106 with the bore 108 receiving choke shaft 28 is located so as to be out of registry with slot 104 when choke valve 44 is in its fully opened position, but to begin registration with slot 104 after the first 5° of rotation of shaft 28 from full open toward closed position, passage 106 and slot 104 being in full registration in the fully closed position of choke valve 44.

Passage 106 opens at the bottom face 94 of body 22 (FIGS. 4 and 7 and 8), and is connected to passage 96 by a cross passageway 110 formed in bottom cover 26 as well as in a sealing gasket 112 (FIGS. 4 and 11) which may be formed integrally with diaphragm 60. Cover 26 may be provided with a raised rib 114 (FIG. 10) to help seal this cross passageway 110 when gasket 112 is pressed against the upper face 116 of cover assembly 26. Additionally, a depressed or recessed ledge 118 may be formed in gasket 112 to cooperate with the rib 114 to further define a sealing connection for cross passageway 110. It is also to be noted that slot 104 in choke shaft 28 faces upstream relative to air flow in bore 40 in the closed condition of choke shaft 28.

OPERATION

The system and method of the present invention will be understood from the following description of the operation of carburetor 20. At engine start-up, when choke valve plate 44 has been rotated by shaft 28 to fully closed position to induce a high vacuum in bore 40 downstream of the choke plate to thereby induce the appropriate start-up fuel flow rate via nozzle 70, shunt passageway 104–110 is fully open and thereby communicates the vent passageway 82–100 with atmospheric pressure upstream of the closed choke plate (usually immediately behind the carburetor air filter, not shown). Hence the pressure wave transmission capability of the vent passageway 82–100 is rendered inoperable, and the high vacuum conditions immediately behind the choke plate in the vicinity of pitot tube 80 cannot be communicated to the dry side chamber 62 because of the shunting effect of the shunt passageway 104–110.

After the engine begins to run under its own power and as choke 44 is rotated toward open position, shunt passageway 104–110 is gradually closed off by the deregistration of slot 104 with passage 106 by the corresponding rotation of shaft 28 in bore 108. Once choke 44 is fully open and the engine is running without choking assistance shunt passageway 104–110 is fully closed and hence vent passageway 82–100 becomes fully operable to transmit pressure wave effects to the dry side chamber 62.

In the engine running mode with choke 44 open, the air flow through the carburetor is not steady because there are moving pressure wave forms generated in the manifold and communicated by the intake air stream in carburetor bore 40. These waves are formed from the opening and closing of the engine intake valve(s) or port(s), and travel at the speed of sound, their behavior being well known. The effect of these waves on the fuel delivered from outlet of the nozzle 70 of the carburetor has long been a source of problems. The wave effect is superimposed on the normal vacuum caused by the velocity of the air flow through venturi 42, and introduces an undesirable pressure variation modulation in venturi 42. Thus, hitherto, this in turn has caused nozzle 70 to deliver fuel in a manner which is not in proper design response to the vacuum caused by the air flow.

It is to be understood that, in the absence of such moving pressure wave forms, the carburetor will function properly when the static pressure drop $\Delta P$ across the main controlling restriction formed in passage 72 by valve 36 (FIG. 5), located some distance from the outlet of nozzle 70 in venturi 42, is proportional to the density and the square of the velocity of the air flow in accordance with the formula relationship:

$$\Delta P = \frac{\rho V^2}{2}.$$

However, when intake tuning pressure waves are present in carburetor 20, the same would be superimposed on the pressure drop $\Delta P$ and would adversely effect fuel metering but for the corrective, canceling counter-or modulating effect of the vent passageway system 82–100 of the present invention. It has been found that vent passageway 82–100 is operable to route the tuning pressure wave to the dry side chamber 62 of the carburetor in such a manner that the pressure wave will be imposed on both sides of diaphragm 60 to thereby counter-modulate or cancel the adverse effect of the pressure wave communicated by nozzle 70 to the wet side chamber 56 of the carburetor, thereby leaving only the desired static pressure drop $\Delta P$ as established by the predetermined design parameters engineered for the particular carburetor and engine application.

As indicated previously, in order to accomplish this it has been found critical to place the venturi-communicating opening 82 of vent passageway 82–100 in the plane of venturi 42, co-planar with nozzle 70, and preferably located in the zone of maximum air flow velocity when choke valve 44 is open. Although the theory of operation is not as yet completely understood, it is believed that this relationship insures that opening 82 and nozzle 70 will be exposed to the same pressure wave at the same instant of time. In any event, this orientation and location relationship, as well as the pitot tube configuration of protuberance 80, have been found to be critical to the ability of the vent passageway 82–100 to counter-modulate or cancel the tuning waves, or to at least cancel or substantially reduce the adverse effect of such tuning waves on the predetermined fuel metering parameters desired for the carburetor.

Fortuitously, vent passageway 82–100 has been found to also perform a second function, namely, it prevents the fuel/air mixture from going over rich as the air filter located upstream of the entrance to the carburetor bore becomes clogged with dirt particles. Vent passageway 82–100 of the present invention thus provides the further advantages of the full inside vent as disclosed in the U.S. Brown Pat. No. 3,174,732 but is believed to be operable in an improved manner thereover to thereby better maintain a predetermined air/fuel ratio regardless of air filter clogging.

The system of the invention is also believed to reduce or eliminate undesirable carburetor performance characteristics resulting from phase shifts between engine suction pulses and tuning wave pulses otherwise occurring with changes in engine speed.

It is also to be understood that the principles of the present invention may be applied to a float bowl carburetor. In such a carburetor the surface of the fuel in the bowl is treated as equivalent to the diaphragm 60, and the vent passageway system in accordance with the invention is operable in a manner similar to that described in conjunction with the hereinabove disclosed diaphragm carburetor 20.

If desired, slightly shifting the location of the pitot tube 80 so as to dispose entrance 82 either slightly forwardly or rearwardly (upstream or downstream relative to air flow) of the plane of the venturi 42 will cause a given pressure wave impingement on nozzle 70 to lead or lag impingement of this wave at entrance 82. The resultant phase shift can thus be established in accordance with an empirically predetermined dimensional relationship relative to the fuel metering effect of diaphragm 60 so as to produce a lean mixture for an economy range or a rich mixture for a power range, as will now be understood by those skilled in the art in view of the foregoing disclosure.

Thus, it will be appreciated from the foregoing disclosure that the preferred embodiments of the fuel metering system, method and apparatus for internal combustion engines described and/or illustrated herein amply fulfill the aforementioned objects of the invention. However, it will be realized that further variations of the inventive concepts will occur from the foregoing disclosure to those skilled in this art.

Figure 10:
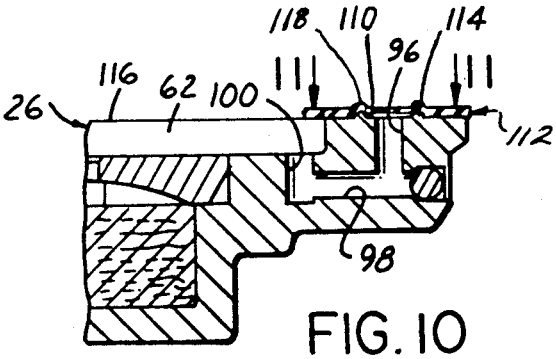
FIG. 10 is a fragmentary cross-sectional view taken on the line 10—10 of FIG. 9.
Figure 12:
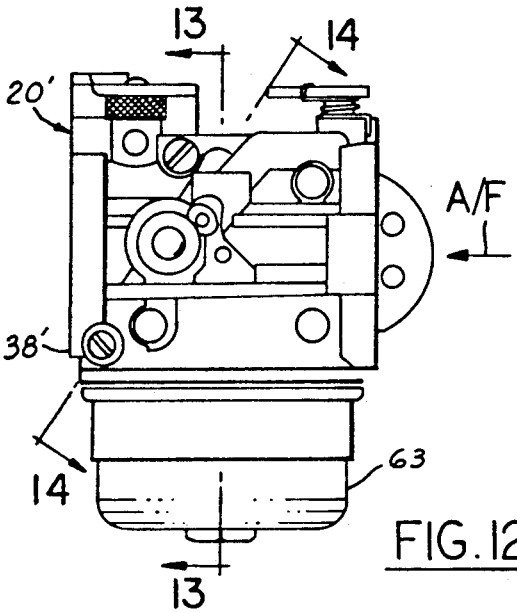
FIG. 12 is a side elevational view of a small, compact float bowl carburetor designed for a twelve horsepower lawn and garden appliance engine application incorporating the improved fuel metering system in a second embodiment of the present invention, the intended direction of engine intake air flow through the carburetor being indicated by the arrow A/F.
Figure 14:
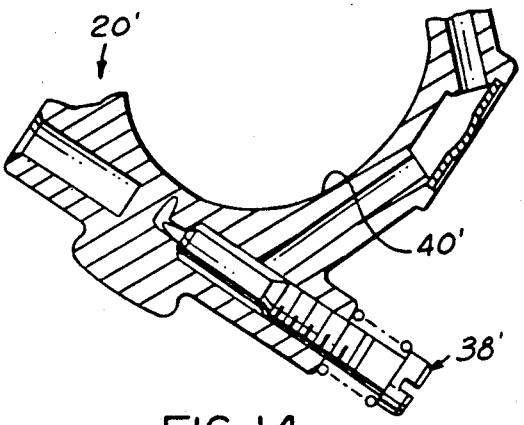
FIG. 14 is a cross-sectional view taken on the line 14—14 of FIG. 12 but enlarged double size thereover.

For example, the effect of the vent passageway 82-100 of the present invention may be modified or modulated by venting the dry side chamber 62 to atmosphere in a controlled manner. As shown in FIGS. 2, 3 and 10, bottom cover assembly 26 may be provided with a well 130 containing filter media 132, and an annular row of slots 134 may be provided in the bottom of the well 130 to communicate filter media 132 with atmosphere. A cover 136 is seated over well 130 and is provided with spaced ribs 137 to press down the filter media 132 so the same is held spaced from the underside of cover 136. A restricted orifice 138 is provided in cover 136 communicating with the head space above filter media 132. Orifice 138 is shown enlarged (not to scale) but preferably has a diameter of .025 inches in a working embodiment of carburetor 20 as determined by emperical testing. Atmospheric bleed orifice 138 on the dry side chamber 62 can thus be employed to modulate the effect of pressure wave cancellation provided by vent passageway 82-100, as may be found desirable for certain engine applications or for particular operating conditions found desirable for given applications.

Figure 19:
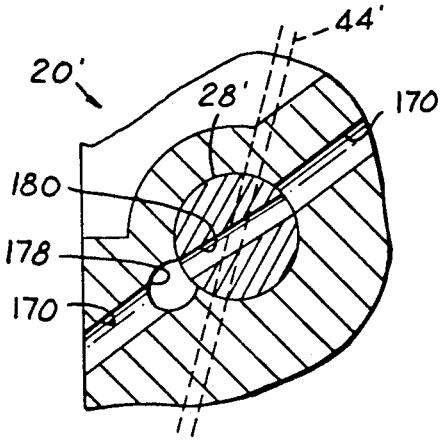
FIGS. 19, 20 and 21 are fragmentary cross-sectional views taken on the line 19—19 of FIG. 17 but enlarged four times thereover and respectively illustrating the orientation of the choke plate, choke shaft and modified shunt or bypass passageway relative to one another with the choke fully closed (FIG. 19), with the choke positioned 15° before full closure (FIG. 20) and with the choke positioned in fully opened condition (FIG. 21) respectively.
Figure 20:
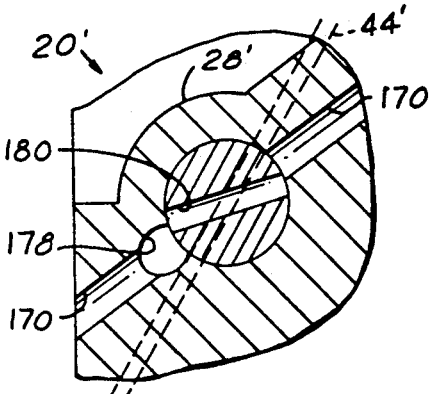
Figure 21:
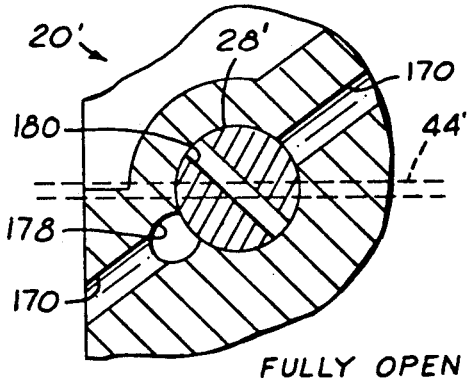

It is to be further understood that the vent passageway system 82-100 of the present invention, because of the pitot tube arrangement of the venturi end of the vent passageway system, better measures or senses both dynamic and static pressure conditions in venturi 42 of bore 40, rather than primiarly static pressure conditions as is the case with prior art vent passageway systems such as that disclosed in the aforementioned Brown '732 patent as well as in the U.S. Pat. No. to Phillips 3,065,957; Brown et al U.S. Pat. No. 3,181,843 and Yagi et al U.S. Pat. No. 4,494,504 (FIGS. 19 and 20).

Although the transit time of a pressure wave in air and liquid is different, it also has been found that, within reasonable limits, the ratio of the liquid path length from the wet side chamber 56 to nozzle 70, to air path length, from dry side chamber 62 to venturi 42 via vent passageway 82-100, can be varied without significantly affecting the operation of the vent passageway in canceling the adverse effect of intake tuning moving pressure waves in the carburetor bore.

In addition, the communication of the sensed pressure wave via the vent passageway system to the dry side chamber 62 has been found to be effectively transmitted to the wet chamber 56 via the diaphragm 60 without thereby adversely affecting the diaphragm in performing its principal function of controlling, via its associated lever linkage 64, the fuel inlet valve 58.

As indicated previously hereinabove, and as illustrated in FIGS. 12 through 24, the foregoing principles of the invention also may be applied to a float bowl carburetor. By way of illustration and not by way of limitation, a prior art commercially available float bowl carburetor 20' manufactured and sold by Walbro Corporation of Cass City, Michigan, assignee of the inventors herein, under Part No. LMK1 for use on a Kohler C.V. 12 engine is illustrated in FIGS. 12 through 24, wherein the same has been modified to incorporate the vent passageway system in accordance with the invention so as to be operable in a manner similar to that described in conjunction with the hereinabove disclosed diaphragm carburetor 20. For purposes of brevity and to facilitate correlation of corresponding structure and function, the float bowl carburetor 20' as shown in FIGS. 12 through 24 is described in association with reference numerals raised by a prime suffix applied to those elements corresponding in structure and function to that described previously in conjunction with carburetor 20, and their description is not repeated inasmuch as the construction of the float bowl carburetor 20' will be well understood by those skilled in the art when viewing the illustrations of FIGS. 12 through 24.

Figure 13:
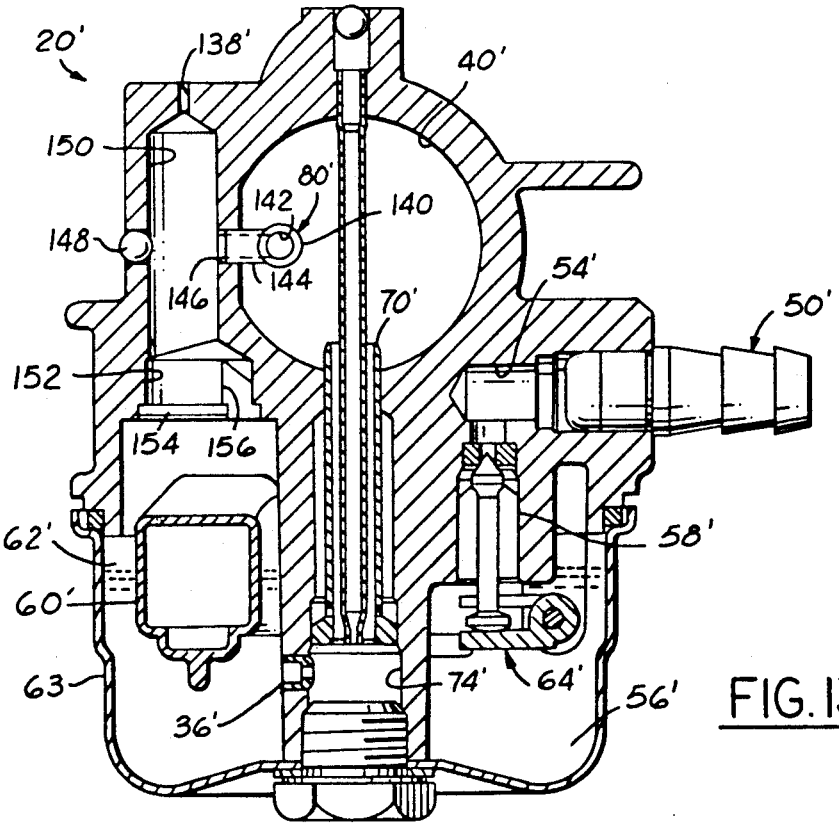
FIG. 13 is a cross-sectional view taken on the line 13—13 of FIG. 12 but enlarged double size thereover.
Figure 15:
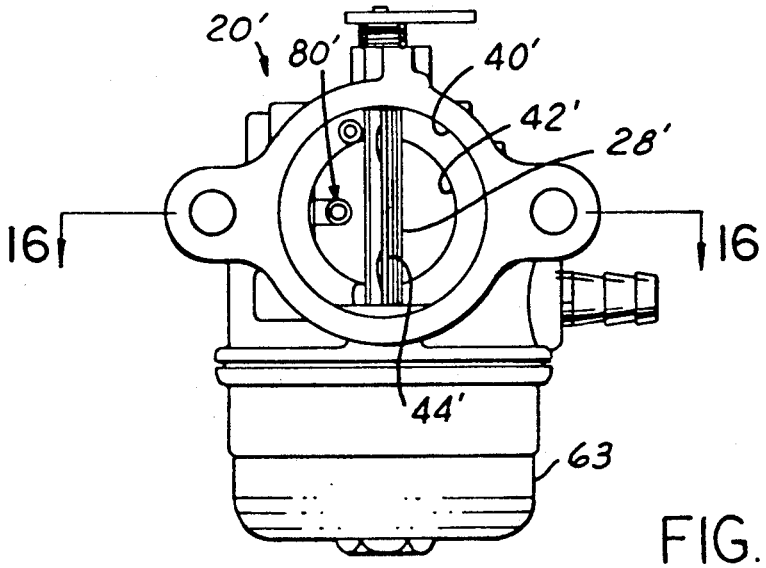
FIG. 15 is an end elevational view of the carburetor of FIG. 12 looking into the choke end of the mixing passage.
Figure 16:
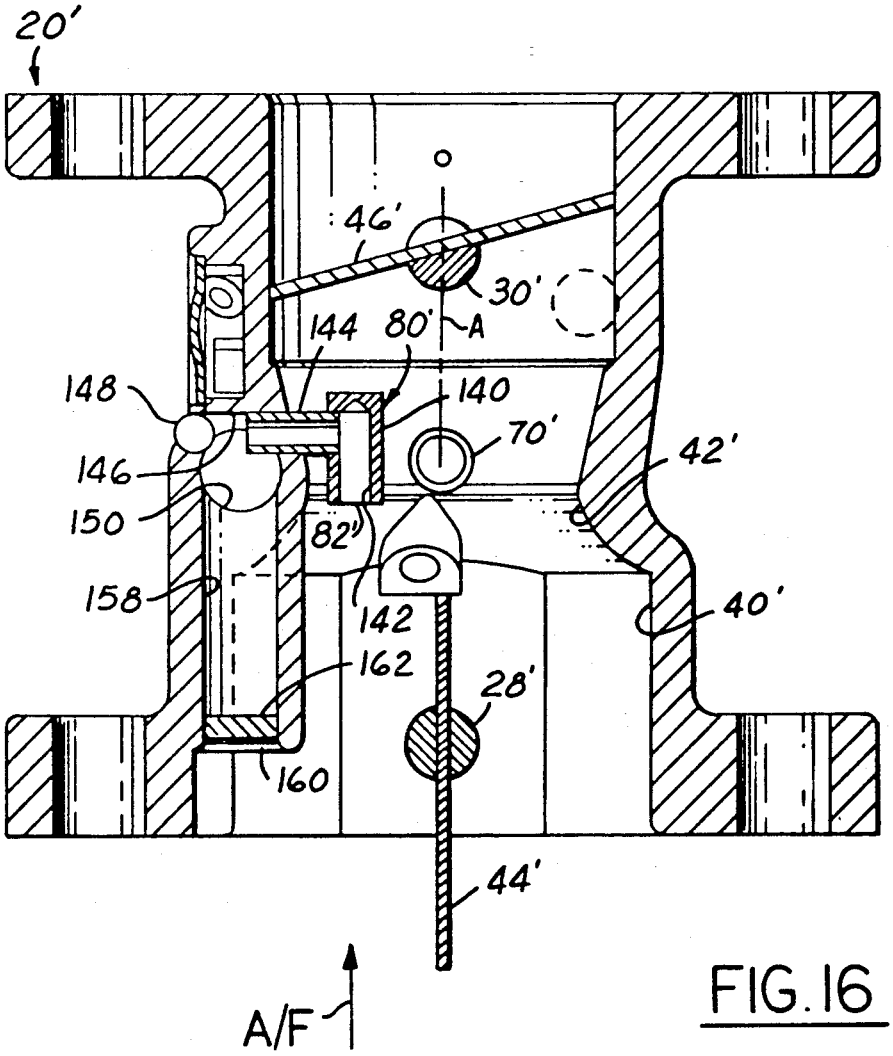
FIG. 16 is a cross-sectional view taken on the line 16—16 of FIG. 15 but enlarged double size thereover.
Figure 17:
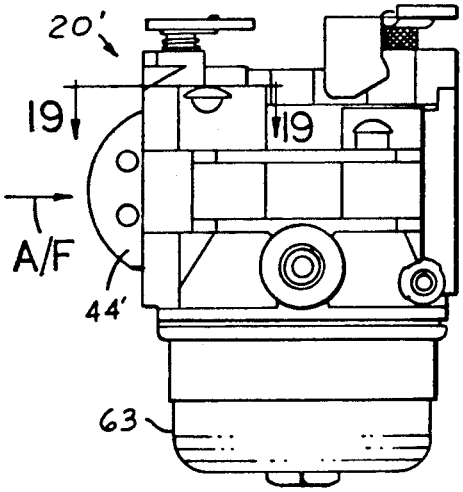
FIG. 17 is a side elevational view of the carburetor of FIG. 12, showing the side opposite that of FIG. 12.
Figure 18:
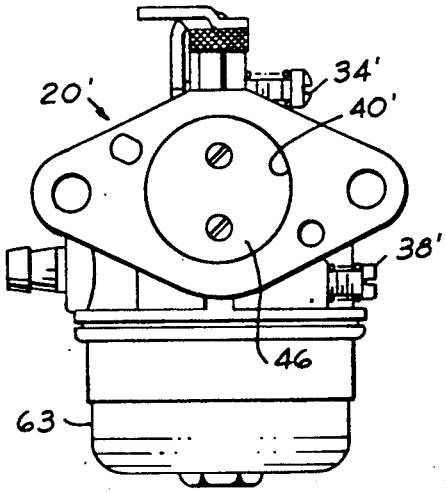
FIG. 18 is an end elevational view of the carburetor of FIG. 12, looking into the throttle end of the mixing passage.

As best seen in FIGS. 13, 15 and 16, float carburetor 20' is provided with a vent passageway system of the present invention operable to modify and/or cancel the effects of tuning pressure waves transisting venturi 42' which otherwise would adversely affect the metering function of fixed high speed jet 36', well 74' and main nozzle 70'. This vent passageway interconnects a specially constructed pressure sensing port in venturi 42' with the head space 62' of the float bowl 63. As will be understood by those skilled in the art, bowl 63 contains liquid fuel in the sump or well thereof in which an annular hollow float 60' is partially submerged, and float bouyancy is operable via lever 64' to control inlet valve 58' in response to fuel sump surface level variations.

Thus, as in the diaphragm carburetor 20, a pitot tube 80' is provided so as to project from venturi 42' into the air flow stream drawn through bore 40' by engine intake suction. Pitot tube 80' in the embodiment illustrated in FIGS. 12-24 may be cast integrally with carburetor body as in the carburetor 20. However, in the embodiment illustrated in FIGS. 12-24, pitot tube 80' is fabricated from separate parts including a cylindrical brass plug 140 having a blind bore 142 drilled therein so that the open end of bore 142 forms a mouth 82' of the pitot tube 80'. A tube 144 is inserted at one end into a side opening drilled in plug 140, and is press fit into a drilled passage 146 which extends perpendicularly to the carburetor axis and which in turn is sealed at its outer end by a press fit ball 148. Passage 146 intersects a larger diameter drilled passage 150 already provided in carburetor 20', and which extends downwardly into a larger diameter counter bore 152 (FIG. 13) and which may, if desired, be at its lower end closed by a welch plug which seats at 154 in accordance with conventional practice. When a welch plug is used, a notch 156 in the sidewall intended to receive the welch plug communicates passage 150 with the head space 62' of bowl 63. As shown in FIG. 16, a large diameter passage 158 extends parallel to the carburetor axis and has its mouth 160 located adjacent the choke end of the carburetor just downstream from the air filter (not shown) normally provided upstream of the entrance to carburetor mixing passage 40'. The downstream end of passage 158 perpendicularly intersects passage 150 and together therewith provides the main air pressure venting system for the float bowl head space 62' in accordance with the conventional practice.

In the adaption of the commercial float bowl carburetor 20' to accomodate the principles of the invention as illustrated herein, passage 158 is sealed by a plug 162 and not utilized. However, in a float bowl carburetor originally designed to incorporate the invention these pre-existing passages 158 and 150 would be eliminated in favor of a simplier passageway from tube 144 to headspace 62'. Likewise, mouth 82' of pitot tube 80' would be designed to be flush with the mid-plane of venturi 42' and the centerline of nozzle 70', unless a phase shift offset relationship as described previously, was desired.

It will be noted from the foregoing and from the illustrations of FIGS. 13, 15 and 16 that pitot tube 80' is oriented and located in a manner quite similar to pitot tube 80 of carburetor 20. The mouth 82' of the entrance bore 142 of pitot tube 80' is disposed a very short distance upstream of the plane of the minor diameter of venturi 42' and just slightly upstream from coplanar relationship with main nozzle 70' in order to accomodate the physical limitations imposed by this pre-existing carburetor design. Passage 142 like passage 86, extends parallel to the main axis A of bore 40' and venturi 42'. Since carburetor 20' is provided with a choke plate 44' mounted on choke shaft 28', similar to diaphragm carburetor 20, pitot tube 80' is offset from axis A toward the side wall of venturi 42' so as to be disposed of about halfway between axis A and the associated side wall of venturi 42'. However, taken vertically in the carburetor as seen in FIGS. 13 and 15, pitot tube 80' is centered in horizontal alignment with axis A. In any event, the entrance mouth 82' of pitot tube 80' is located in the chordal space just downstream of choke plate 44' wherein engine induced air flow velocity is maximized, taken into consideration the presence of choke plate 44' and choke shaft 28' and their obstructing effect relative to air flow through carburetor bore 40' and venturi 42'.

Inasmuch as float bowl carburetor 20', like diaphragm carburetor 20, is provided with a choke valve 44', and pitot tube 80' is located directly downstream of choke valve 44', carburetor 20' is also provided with a shunt passageway system for producing a by-passing "shut-off" of the effect of the vent passageway 142, 144, 150, 156 when initiating choke valve closure. This "shut-off" shunt passageway comprises, as best seen in FIGS. 19-21 and 24, a drilled passage 170 extending from the front face of carburetor 20' parallel to axis A and diametrically intersecting the bore 29 (FIG. 24) which receives choke shaft 28' above choke plate 44'. The inner end of passage 170 terminates at an intersection with an angled drilled passage 172 which in turn intersects the upper end of passage 150. The outer end of passage 170 is sealed by press fit ball 174, and likewise the outer end of passage 172 is sealed by a press fit ball 176. Another angled drilled passage 178 is provided upstream of choke plate 44', near its upper edge, and which opens into carburetor bore 40'. Passage 178 intersects passage 170 where both passages meet choke shaft bore 29. Choke shaft 28' is provided with a drilled cross passage 180 extending diametrically of shaft 28' so as to be rotatable, in response to choke shaft rotation, into and out of registry at its opposite ends with passages 170 and 178.

Hence, as seen by comparing FIGS. 19 and 20, when choke plate 44' is in fully closed position (FIG. 19), the upper end space of passage 150 is in communication via passages 172, 170 and 178 with bore 40' upstream of the closed choke plate. As choke plate 44' is rotated by shaft 28' from fully closed position through an angle of 15° the communication via passage 180 is gradually shut off. As choke shaft rotation continues (clockwise as viewed in FIGS. 19-21) beyond 15° from closing, to the fully opened position of the choke plate 44' shown in FIG. 21 deregistration of passage 180 with passage 170 shuts off communication between passages 178 and passage 150.

From the previous description of diaphragm carburetor 20, and choke shunt passageway 104-110 embodied therein, it will be understood that the pressure wave transmission capability of vent passageway 142, 144, 146 is rendered inoperable when the choke valve is closed as in FIG. 19, and hence the high vacuum conditions immediately behind choke plate 44' in the vicinity of pitot tube 80' cannot be communicated to the air chamber 62' of the float bowl 63' because of the shunting effect of the shunt passageway 178, 180, 170. After the engine begins to run under its own power and choke 44' is rotated toward open position, shunt passageway 180 is gradually closed off by the deregistration of passage 180 with passage 178 and 170 by the corresponding rotation of shaft 28'. Once choke 44' is fully open and the engine is running without choking, shunt passageway 178, 180, 170 is fully closed and hence vent passageway 142, 144, 146 becomes fully operable to transmit pressure wave effects to the air chamber 62' of the float bowl 63.

As in carburetor 20, the effect of the vent passageway 142, 144, 150 may be modified or modulated in carburetor 20' by venting the bowl headspace 62' to atmosphere in a controlled manner. For this purpose, a restricted orifice 138' is provided in the body of carburetor 20' communicating passage 150 with atmosphere, in the manner of orifice 138 as described previously in conjunction with carburetor 20.

It will thus be seen from the foregoing that the principles of the invention, as described in detail and conjunction with diaphragm carburetor 20, can also be readily embodied in a float-controlled carburetor 20' by modifying the same in essentially the same manner and for the same purposes as described in conjunction with diaphragm carburetor 20.

In view of the above, the invention should not be limited to the preferred embodiments described and/or shown herein, but can be modified in various ways within the scope of the appended claims and applicable prior art.

We claim:

1. In combination with a two-stroke cycle internal combustion engine having a cylinder, a piston reciprocable in said cylinder and a crankcase, a diaphragm type carburetor comprising a body providing a venturi, a cavity in said body, a metering diaphragm dividing said cavity into a metering chamber and a dry chamber, means for supplying fuel to said metering chamber including metering valve means actuatable by said diaphragm, a main fuel restriction connected with said metering chamber through a high speed needle valve, and vent passageway means connecting said dry chamber with said venturi and having a pitot tube inlet in said venturi constructed and arranged to apply engine intake induced pressure waves to said dry chamber such that said waves are impressed upon the fuel in s id metering chamber without adversely affecting the normal function of the diaphragm in opening and closing said metering valve means to supply more or less fuel to said metering chamber and to said main fuel restriction during running of said engine in response to design air flow conditions controlling the pressure drop across said main fuel restriction while preventing or reducing the adverse effects of such waves on the pressure drop across said main fuel restriction.

2. In an all-position carburetor system for moving liquid fuel from a supply to an engine including a carburetor body to be mounted on an engine having a mixing passage with a venturi portion and a diaphragm chamber having a wet side and a dry side, an inlet control valve, a diaphragm acting on said valve in said chamber for controlling the opening and closing of said valve, and supply passages leading from a fuel supply inlet via said wet side chamber to a main fuel nozzle opening at the venturi portion of said mixing passage, that improvement in combination therewith which comprises:

a. a pneumatic passage in said carburetor body having one end in the form of a pitot tube constructed and arranged in said venturi portion of said conduit to serve as an inlet adapted to be connected to the intake air flow stream induced by the engine to convey intake tuning pressure wave effects to said dry side chamber, b. a choke valve in said mixing passage movable from an open choke position to a closed choke position, c. valve means responsive to movement of said choke valve to render said pneumatic passage operable to transmit said wave effects to said dry side chamber when said choke is moved to ooen position, and to render said pneumatic passage inoperable to transmit said wave effects to said dry side chamber when said choke is closed, and d. an air bleed passage connecting atmospheric air from a point spaced from the venturi portion of the mixing passage to said dry side chamber to thereby modulate the operable effect of said pneumatic passage on said dry side chamber.

3. A carburetor comprising in combination a body, a fuel and air mixture conduit through said body, said body formed with a fuel chamber, said mixture conduit having an inlet and an outlet and a venturi restricted portion intermediate said inlet and outlet, a fuel inlet and fuel passage extending from sad fuel inlet to said fuel chamber, an inlet valve in said fuel passage between said fuel inlet and said fuel chamber, a main fuel nozzle having an outlet opening within said conduit restricted portion, said main fuel nozzle outlet opening being oriented relative to said mixture conduit to sense solely static pressure therein, said body having a pitot tube with only one inlet opening communicating with said mixture conduit, said pitot tube inlet opening facing upstream relative to the air flow direction in said mixture passage and disposed in said restricted portion in a zone of maximum air flow, said body having a fuel connection from said fuel chamber to said main fuel nozzle and including main fuel controlling restrictions means therein, diaphragm or float means for operating said inlet valve, means forming a single closed air chamber cooperable with said diaphragm or float means to regulate operation thereof relative to said inlet valve, said body including a first passageway connecting said pitot tube solely to said air chamber such that said pitot tube inlet communicates only with said air chamber in the run operational mode of said carburetor whereby said diaphragm or float means is responsive to the drop in air pressure at said conduit restrictive portion to vary the constant pressure of fuel in said fuel chamber directly in response to changes of air pressure at said nozzle without the pressure drop across said main fuel controlling restriction means being adversely affected by the presence of engine intake induced turning pressure wave forms in said conduit and without adversely affecting the function of said diaphragm or float means in regulating operation of said inlet valve.

4. The combination set forth in claims 1, 2 or 3 wherein said main nozzle opening into said venturi and said pitot tube inlet are both disposed generally in a common plane perpendicular to the axis of said venturi.

5. The combination set forth in claims 1, 2 or 3 wherein said main nozzle opening into said venturi and said pitot tube inlet are offset spaced from one another a predetermined distance relative to the direction of engine intake induced air flow through said venturi such that said spacing is operable to produce a predetermined phase shift in the effect of an intake tuning pressure wave form alternatively impinging said pitot tube inlet and main nozzle opening.

6. In combination with an internal combustion engine having a cylinder, a piston reciprocable in said cylinder and a crankcase, a diaphragm type carburetor comprising a body providing a venturi, a cavity in said body, a metering diaphragm dividing said cavity into a metering chamber and a dry chamber, means for supplying fuel to said metering chamber including metering valve means actuatable by said diaphragm, a main fuel feeding passageway having an inlet communicating with said metering chamber and including fuel controlling restriction means therein and a fuel outlet disposed in said venturi with an outlet opening disposed with its axis generally perpendicular to the direction of engine induced air flow through said venturi and with the plane of the outlet opening being disposed generally parallel to such air flow direction, and vent passageway means connecting said dry chamber with said venturi and having a pitot tube inlet in said venturi with an inlet opening facing upstream and with the plane of said pitot inlet opening disposed generally perpendicular to the aforesaid air flow direction so as to apply engine intake induced pressure waves to said dry chamber such that said waves are impressed upon the fuel in said metering chamber without adversely affecting the normal function of the diaphragm in opening and closing said metering valve means to supply more or less fuel to said metering chamber and to said main fuel restriction during running of said engine in response to design air flow conditions controlling the pressure drop across said main fuel restriction while preventing or reducing the adverse effects of such waves on the pressure drop across said main fuel restriction.

7. A carburetor for an internal combustion engine comprising in combination a body, a fuel and air mixture conduit through said body, said body formed with a fuel chamber, said mixture conduit having an inlet and an outlet and a venturi restricted portion intermediate said inlet and outlet, a fuel inlet and a fuel passage extending from said fuel inlet to said fuel chamber, an inlet valve in said fuel passage between said fuel inlet and said fuel chamber, a main fuel nozzle within said mixture conduit restricted portion having a fuel feeding outlet opening disposed with its axis generally perpendicular to the direction of engine induced air flow through said venturi restricted portion and with the plane of nozzle outlet opening disposed generally parallel to such air flow direction, said body having a pitot tube with an inlet opening facing upstream and disposed in said restricted portion in a zone of maximum air flow, parallel to the aforesaid air flow direction and with the plane of said pitot tube inlet opening generally perpendicular to the aforesaid air flow direction, said body having a fuel connection from said fuel chamber to said main fuel nozzle and including main fuel controlling restrictions means therein, diaphragm or float means for operating said inlet valve, means forming a single closed air chamber cooperable with said diaphragm or float means to regulate operation thereof relative to said inlet valve, said body including a vent passageway connecting said pitot tube inlet solely to said air chamber such that said pitot tube inlet communicates only with said air chamber in the run operation mode of said carburetor whereby said diaphragm or float means is responsive to the drop in air pressure at said conduit restrictive portion to vary the constant pressure of fuel in said fuel chamber directly in response to changes of air pressure at said nozzle outlet opening without the pressure drop across said main fuel controlling restriction means being adversely affected by the pressure of engine intake induced tuning pressure wave forms in said conduit and without adversely affecting the function of said diaphragm or float means in regulating operation of said inlet valve.

8. The combination set forth in claim 7 wherein said main nozzle outlet opening into said venturi and said pitot tube inlet opening are both located generally in a common plane perpendicular to the axis of said venturi.

9. The combination set forth in claim 8 wherein said main nozzle outlet opening into said venturi and said pitot tube inlet opening are offset spaced from one another a predetermined distance relative to the aforesaid direction of engine intake induced air flow through said venturi such that said spacing is operable to produce a predetermined phase shift in the effect of an intake tuning pressure wave form alternatively impinging said pitot tube and main nozzle opening.

10. The combination set forth in claims 7, 8 or 9 further including a choke valve in said mixture conduit movable from an open choke position to a closed choke position, valve means responsive to movement of said choke valve to render said vent passageway operable to transmit said wave effects to said air chamber when said choke is moved to open position, and to render said vent passageway inoperable to transmit said wave effects to said air side chamber when said choke is closed.

11. A system for metering fuel to an internal combustion engine having a cylinder, a piston reciprocable in said cylinder and a crankcase, a carburetor comprising a body providing a venturi, means for supplying fuel to said venturi including metering inlet valve means actuatable by an associated diaphragm or float means, a cavity in said body, means forming a single closed air chamber in said cavity cooperable with said diaphragm or float means to regulate operation thereof relative to said inlet valve means, main fuel controlling restriction means and a main fuel nozzle connected with said fuel supply means through a high speed needle valve, said main fuel nozzle outlet opening being oriented relative to said mixture conduit to sense solely static pressure therein, said system further comprising:

(1) pitot tube means disposed in said venturi for sensing dynamically the engine intake induced pressure waves transmitting said venturi to develop a pressure wave signal, (2) means for transmitting said sensed pressure wave signal to said chamber, and (3) means for developing a predetermined phase relationship between impingment of said waves on said main fuel nozzle and the sensed pressure wave signal to thereby modulate the effect of said wave impingement on the static pressure drop developed across said main fuel restriction means in response to engine intake air flow through said venturi, and wherein said main nozzle opens into said venturi and said sensing means and said phase means comprises a pitot tube disposed in a common plane with said nozzle, said plane being perpendicular to the axis of said venturi and intersecting said main nozzle.

12. A method of metering fuel to an internal combustion engine having a cylinder, a piston reciprocable in said cylinder and a crankcase, a carburetor comprising a body providing a venturi, means for supplying fuel to said venturi including metering inlet valve means actuatable by an associated diaphragm or float means, a cavity in said body, means forming a single closed air chamber in said cavity cooperable with sad diaphragm or float means to regulate operation thereof relative to said inlet valve means, main fuel controlling restriction means and a main fuel nozzle disposed in said venturi with an outlet opening having its axis disposed generally perpendicular to the direction of engine intake induced air flow through said venturi, said nozzle being connected with said fuel supply means through a fuel controlling restriction, said method comprising the steps of:

(1) sensing dynamically the engine intake induced pressure waves transmitting said venturi to develop a pressure wave signal, (2) transmitting said sensed pressure wave signal to said air chamber, and (3) developing a predetermined phase relationship between impingement of said waves on said main fuel nozzle outlet opening and the dynamically sensed pressure wave signal to thereby modulate the effect of said wave impingement on the static pressure drop developed across said main fuel restriction means in response to engine intake air flow through said venturi, and wherein said sensing step is performed with a pitot tube having its inlet opening facing upstream and located substantially in a common plane with said nozzle outlet opening, said common plane being perpendicular to the aforesaid air flow direction and intersecting said main nozzle outlet opening.

* * * * *

UNITED STATES PATENT AND TRADEMARK OFFICE

CERTIFICATE OF CORRECTION

PATENT NO. : 5,133,905

DATED : July 28, 1992

INVENTOR(S) : John C. Woody and Mark S. Swanson

It is certified that error appears in the above—identified patent and that said Letters Patent is hereby corrected as shown below:

Col. 12, Line 64, change "s id" to — said —.

Col. 13, Line 29, change "ooen" to — open —.

Col. 14, Line 3, change "turning" to — tuning —.

Col. 14, Line 69, insert "said pitot tube inlet opening being disposed with its axis generally".

Col. 15, Line 13, change "operation" to — operational —.

Col. 16, Line 29, change "sad" to — said —.

Signed and Sealed this

Twenty-first Day of September, 1993

Bruce Lehman

*Attest:*

BRUCE LEHMAN

*Attesting Officer*

*Commissioner of Patents and Trademarks*